US006182879B1

(12) United States Patent
König et al.

(10) Patent No.: US 6,182,879 B1
(45) Date of Patent: Feb. 6, 2001

(54) DEVICE FOR MOVING A THREAD TO A WINDING SLEEVE DRIVEN BY A FRICTION ROLLER

(75) Inventors: Günter König, Uhingen (DE); Werner Mayer, Paarl (ZA)

(73) Assignee: Zinser Textilmaschinen GmbH, Ebersbach/Fils (DE)

( * ) Notice: Under 35 U.S.C. 154(b), the term of this patent shall be extended for 0 days.

(21) Appl. No.: 09/274,494

(22) Filed: Mar. 23, 1999

(30) Foreign Application Priority Data

Mar. 26, 1998 (DE) ..... 198 13 515

(51) Int. Cl.[7] ..... B65H 54/71
(52) U.S. Cl. ..... 226/97.4
(58) Field of Search ..... 226/97.4, 92, 7; 242/487.5

(56) References Cited

U.S. PATENT DOCUMENTS 3,242,662 * 3/1966 Shealy, Sr. et al. .
3,334,161 * 8/1967 Guzman ..... 226/97.4 X
3,409,195 * 11/1968 Benson ..... 226/7
3,608,843 * 9/1971 Seidlich .
3,690,530 * 9/1972 Porter .
3,964,722 6/1976 Boogs .
3,991,545 * 11/1976 Ritter et al. .
4,215,805 * 8/1980 Nielsen ..... 226/97.4
4,453,709 * 6/1984 Reba ..... 226/7 X
4,593,521 * 6/1986 Stalder et al. ..... 226/7 X
4,858,809 * 8/1989 Paulini et al. ..... 226/97.4 X
5,056,728 * 10/1991 Scaglia ..... 226/97.4 X
5,105,855 * 4/1992 Stacher .

FOREIGN PATENT DOCUMENTS 2 220 977 11/1972 (DE) .
40 12 800 10/1990 (DE) .
57-107372 * 3/1982 (JP) .

* cited by examiner

*Primary Examiner*—Donald P. Walsh
*Assistant Examiner*—Collin A. Webb
(74) *Attorney, Agent, or Firm*—Herbert Dubno

(57) ABSTRACT

A device for moving a thread to a winding sleeve driven by a friction wheel, especially in a stretch-winding machine, has a tubular portion adjacent the mouth into which the thread is drawn by suction and which is provided with at least one blade to sever the thread with a minimum tension applied thereto. That keep the loose ends as short as possible.

11 Claims, 4 Drawing Sheets

DEVICE FOR MOVING A THREAD TO A WINDING SLEEVE DRIVEN BY A FRICTION ROLLER

FIELD OF THE INVENTION

Our present invention relates to a device for moving a thread into engagement with a winding sleeve driven by a friction roller and, more particularly, to a winding sleeve of a stretch-winding machine or the like in which the thread is engaged in a thread-capturing slit of the winding sleeve. The invention relates especially to a suction device for this purpose having a tubular end piece or terminal member which sucks in the thread and can be moved while the thread is engaged thereby to deliver the thread to the thread-capture slit of the winding sleeve.

BACKGROUND OF THE INVENTION

It is already known to use a suction device to displace a thread, especially in stretch-winding machines in which a thread, usually comprised of a multiplicity of filaments and of a synthetic resin material, is subjected to thermal treatment and stretching and then is wound up into a yarn package or bobbin on a winding sleeve or tube, preferably in a cross-winding operation wherein the turns of one layer are oriented with an opposite inclination from the turns of another, i.e. are pitched oppositely to the winding stations. The winding stations are provided with winding units each of which can include a rotatable winding sleeve, a friction roller which bears against the outer periphery of the winding sleeve and the layers of the thread wound thereon, a cross-winding box or device for generating the different orientations of the turns of the layers and a spool holder and a spool carriage.

The full spools, following completion of a winding operation, must be replaced by winding sleeves or tubes. This replacement can be carried out automatically or manually and, in the case of manual replacement, it is necessary that the thread be engaged, usually by a suction device, for example a suction gun, and carried to the winding sleeve at which the thread is then engaged by the winding sleeve.

For effective engagement of the thread, the winding sleeve can be formed with a V-shaped thread-capture slit which can extend over part of the periphery of the winding sleeve at an end region thereof.

The application of the thread to a stretch-winding machine generally has required heretofore the following steps:

The thread which is to be picked up is removed by means of a suction device from a supply station (usually a bobbin in a creel) and fed via a thread-monitoring device or thread-separating device to a supply cylinder. From this cylinder it is passed around at least one and preferably two or three gallets (e.g. an input gallet, a preheating gallet, a fixing gallet and a feed or supply gallet) and the associated transfer rollers. Between the individual gallets, working elements, for example heating devices such as plate heaters can be provided. The thread is then supplied via the cross-winding mechanism to the V-shaped thread-capture slit of the winding sleeve as close as possible to the contact line with which the friction roller engages the winding sleeve. The thread-capture slit engages the thread and tears the latter in a controlled manner. The length thread fed by the supply or feed gallet is wound on the winding sleeve.

In practice, this system has a number of problems, especially with respect to the tearing of the thread. If the thread is a high-strength material, the tearing or rupture of the thread requires relatively high tearing force. This tearing force can have the effect of briefly reducing the speed of the winding sleeve driven by the friction roller. This in turn can loosen the thread reserve and the first few windings or turns of the thread on the winding sleeve. The result is a reduction in quality of the spool. The thread breakage is generally carried out in the region of the suction device, i.e. in the region of the suction gun.

Furthermore, the length of the thread end is not controllable. This uncontrollable length, which can be between 10 and 30 cm depending upon the type of system used to apply the thread to the winding sleeve (and in the case of a suction gun) to a meter or more as is the case with an applicator tube with a stationary injector as the suction device, gives rise to a significant quality problem. Slack loops on the winding sleeve can catch impurities and contaminants like lint and excessively long thread ends can be bound in an uncontrollable manner in the body of the bobbin or yarn package.

OBJECTS OF THE INVENTION

It is the principal object of the present invention to minimize the thread end length with a suction unit for moving a thread to a winding sleeve driven by a friction roller in, for example, a stretch-winding machine.

Another object of the invention is to provide a device of the type described which is free from the drawbacks previously mentioned.

SUMMARY OF THE INVENTION

These objects and others which will become apparent hereinafter are attained in a device for moving a thread to a winding sleeve driven by a friction roller, especially in a stretch-winding machine, which comprises:

a suction element connected to a suction source;

a terminal tubular member connected to the element and having a mouth at which a thread is drawn into the member; and means forming at least one cutting edge in the terminal tubular member for severing a thread drawn into the device.

A device for manipulating a yarn or thread having a suction gun for manual movement of the thread is known from German patent document DE 22 20 977. This device has an air pipe connected to an air source and has an air inlet tube with an inlet opening at one end which communicates via an elbow fitting with the air-supply tube. The pipe is closed by an air reflector which is so configured that the air stream is reversed. An outlet pipe is provided which is arranged coaxially with the rear end of the nozzle tube so that between them an annular opening is formed. This arrangement, however, has not proved to be fully satisfactory and it is particularly desirable to minimize the length of the thread end and also to minimize the tearing force required for separation of the thread.

With the system of the invention, the thread is engaged within the tubular member by at least one cutting edge, preferably on a blade mounted in or as part of the member so that the length of the thread end is defined primarily by the length of the member between the cutting edge and the mouth and such that the force required to rupture the thread is held to a minimum because the thread is cut through by that edge.

According to a feature of the invention the cutting edge is formed on a blade located in the interior of the tubular member although it is also possible to provide two blades within the member at a spacing from one another.

These blades can be diagonally opposite one another and oriented diagonally in opposite directions but inclined toward the direction in which the thread travels into the member. The cutting edges can project from opposite sides toward and beyond the center line of the tubular member. The blades can be replaceable on the member and can be constituted of steel, a steel core with a ceramic coating or from ceramic.

According to a feature of the invention the suction mouth of the tubular member can have a reduced diameter, i.e. a diameter less than the internal diameter of the tubular member beyond the mouth and for that purpose a ring can be inserted into the tubular member. The ring can be composed of ceramic or another material of low friction and high wear-resistance.

BRIEF DESCRIPTION OF THE DRAWING

The above and other objects, features, and advantages will become more readily apparent from the following description, reference being made to the accompanying drawing in which.

SPECIFIC DESCRIPTION

Figure 9:
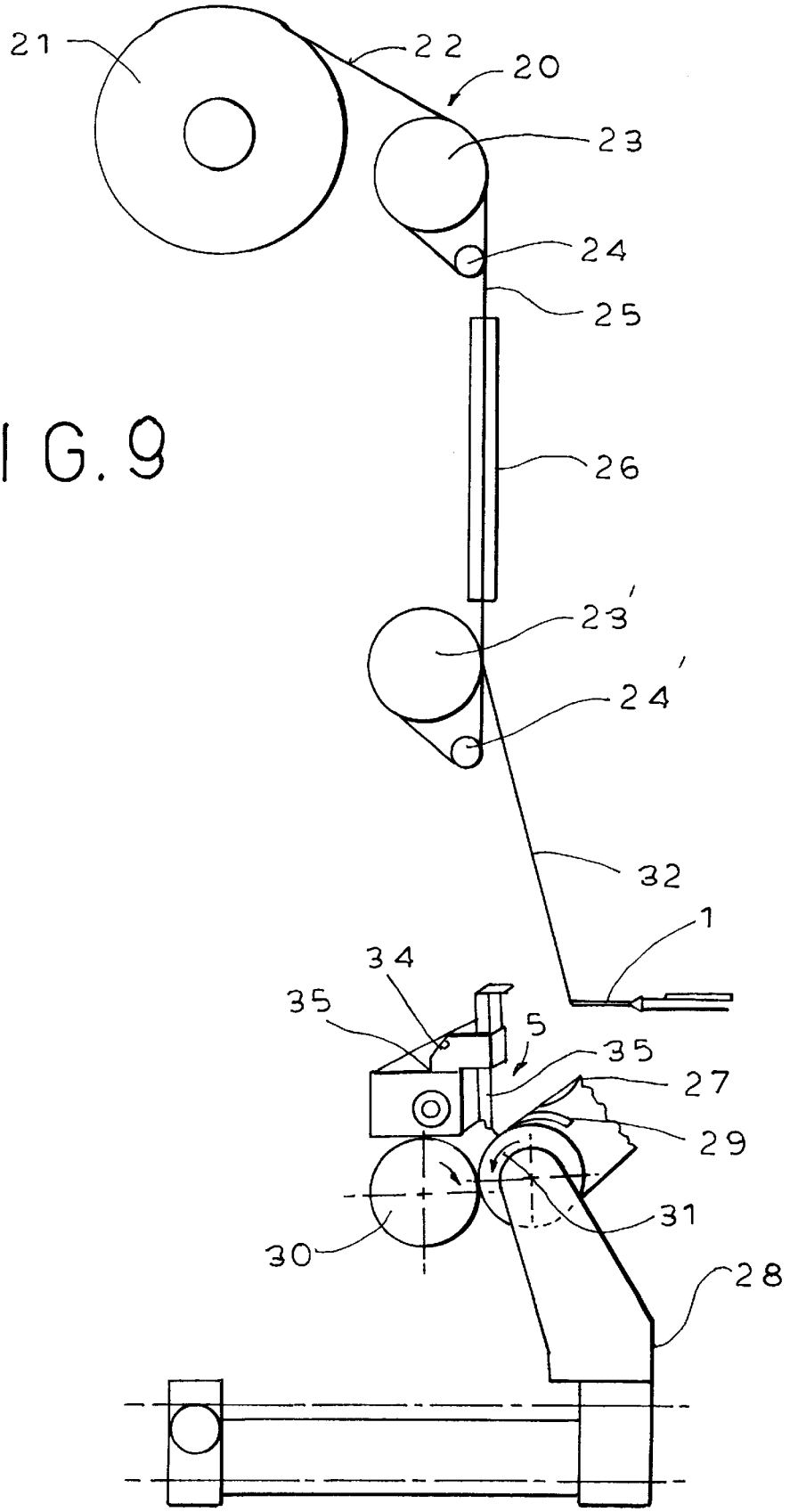
FIG. 9 is a diagram of a winding station showing use of the suction device.

In FIG. 9 of the drawing we have shown a stretch winding machine 20 for synthetic filaments which are formed into a thread and which is provided with a device for moving the thread to a winding sleeve driven by a friction roller. The system may be that of copending application Ser. No. 09/273,917 filed Mar. 21, 1999 and corresponding to German application 198 13 491. That apparatus comprises a source 21 of the threads or filaments 22 to be stretched between the gallets 23 and 23', each of which has an auxiliary roller 24 and 24', and around which the thread passes in a nubmer of turns.

The stretch 25 between the gallets 23 and 23' is provided with a heater 26. The thread then passes as represenetd by the arrow 32 to a device 1 for moving the thread 26 to a winding sleeve 27 on a carriage 28 and having a thread-capture slit diagrammatically shown at 29. The winding sleeve 27 is driven by a friction roller 30 and, to assist in entraining the thread 26 onto the sleeve 27 at a quadrant thereof in which the sleeve is moving in the same direction 31 as the thread (arrow 32), a thread guide member 33 is movable vertically in a bracket 34 as described in the aforementioned copending application. The brackets 34 of the thread guides of a number of such winding stations are mounted on a rail 35 affixed to a cross-winding box 36 which controls the angle with which successive layers of the thread are applied to the winding sleeve 27.

Figure 1:
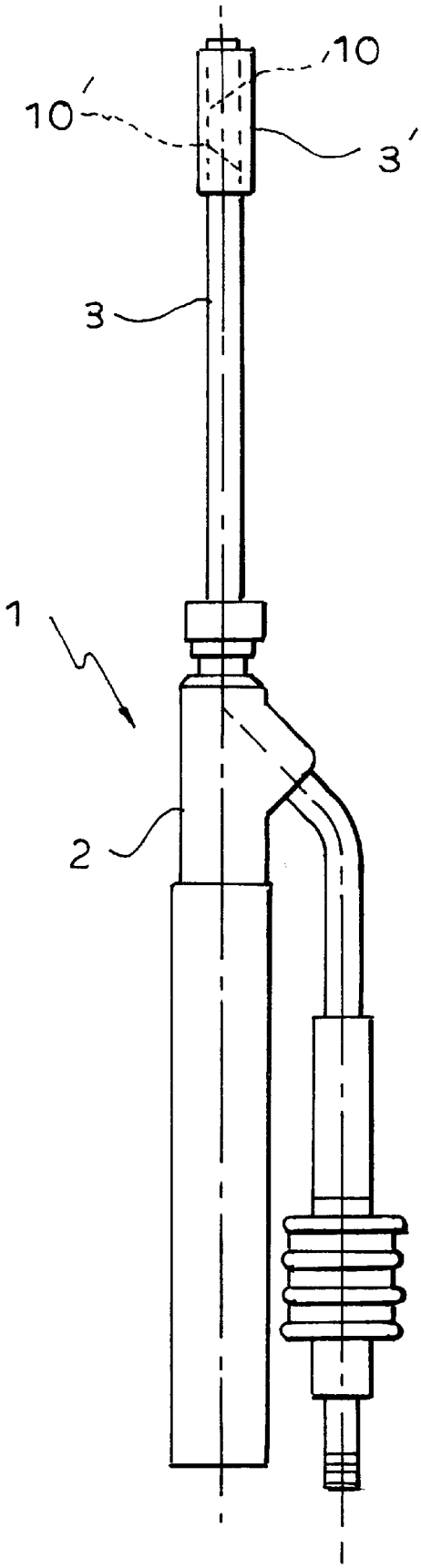
FIG. 1 is a diagrammatic elevational view of a suction gun according to the invention.
Figure 2A:
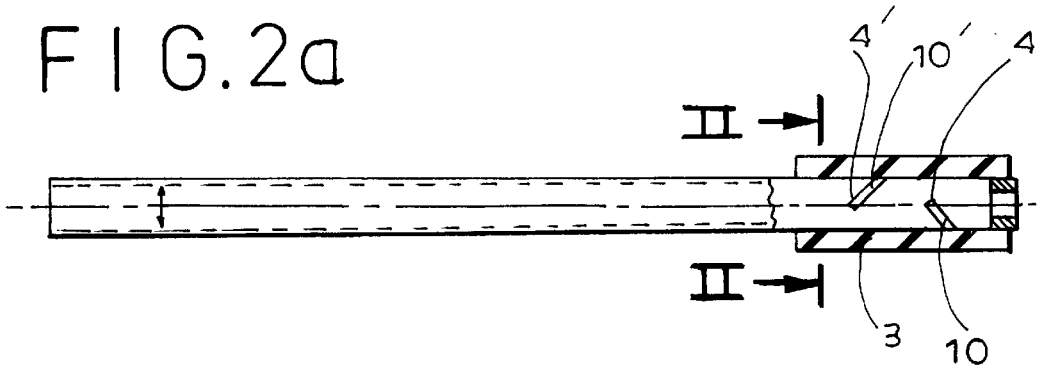
FIG. 2*a* is a detail view, partly in section or broken away showing two blades within the tubular member proximal to the mouth.
Figure 2B:
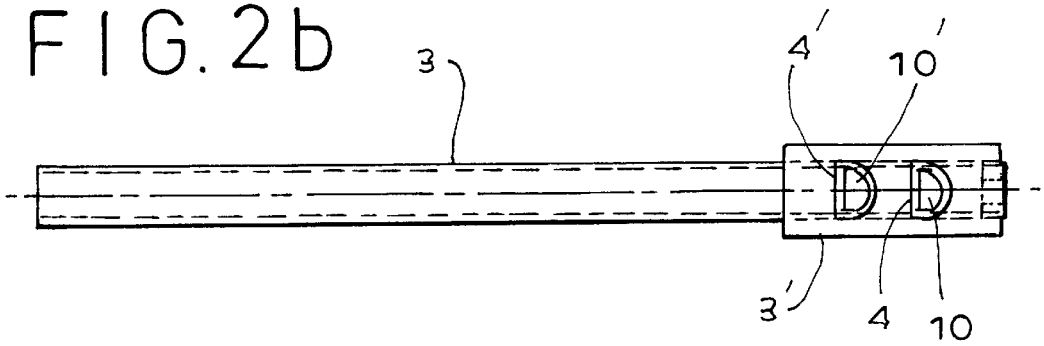
FIG. 2*b* is another view schematically showing the terminal region with two blades.
Figure 3:
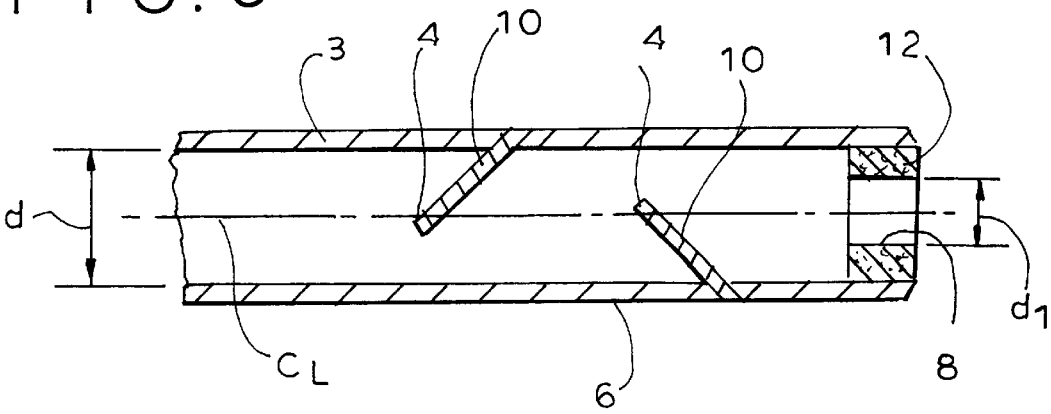
FIG. 3 is an enlarged axial section of the mouth region according to a feature of the invention.

Turning to FIGS. 1–3, it can be seen that the device 1 for moving the thread to a location adjacent the winding sleeve comprises a suction element 2 with a tubular terminal portion 3 which engages the thread and holds the thread as the device 1 is moved to bring the thread under the thread guide 33 and onto the winding sleeve 27 at the region of the thread-capture slit 29. The terminal portion 3 is surrounded at its front end by a sleeve 3'.

Figure 2C:
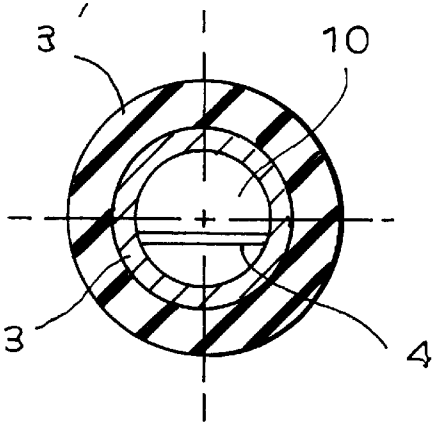
FIG. 2*c* is an enlarged section taken along the line II—II of FIG. 2*a*.

From FIGS. 2*a*–2*c*, it will be apparent that the tubular terminal portion 3 can be formed with at least two cutting edges 4, 4', internally, each of the cutting edges being provided on an inwardly projecting blade 10, 10' which is inclined in the direction I in which the thread is drawn by suction into the tube 3. When two blades 10 and 10' are provided, they are spaced from one another and lie diagonally opposite each other. The tubular portion 3 (see FIG. 3) has a suction mouth 8 with an internal diameter $D_1$ which is less than the internal diameter d of the interior 6 of the tube in which the blades 10 and 10' are arranged.

The blades can be formed by cutting into the wall of this cylindrical end portion 3 and pressing the cut out wall portion of the tube inwardly, the hole made by this fashion being covered by the sleeve 3'. The smaller diameter mouth 8 may be defined by a ring 12 of a ceramic or other material of low sliding friction fitted into the tube end.

As can be seen from FIG. 3 also, the blades 10 and 10' can project inwardly beyond the centerline CL of the tube from above and below. When the blades 10 and 10' are removably fitted into slits in the wall 3, the sleeve 3' can be omitted.

Figure 5:
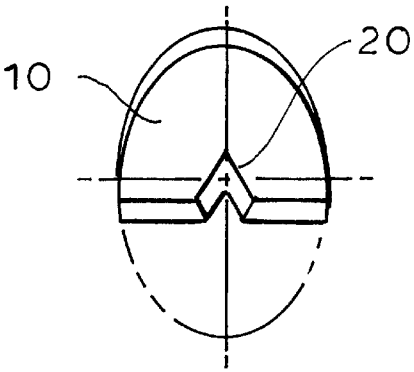
FIG. 5 is a view similar to FIG. 4*b* showing another embodiment of the blade.
Figure 4B:
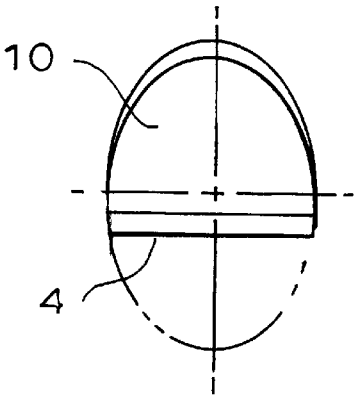
FIG. 4*b* is a front view of the blade of FIG. 4*a*.
Figure 4A:
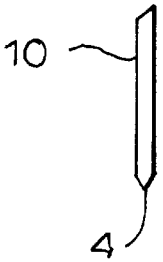
FIG. 4*a* is a side view of a blade in the apparatus of the invention.
Figure 8:
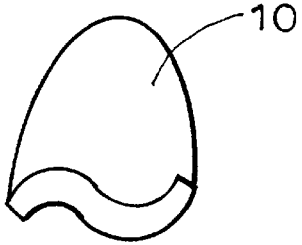
FIG. 8 is an elevational view through the blade.
Figure 7:
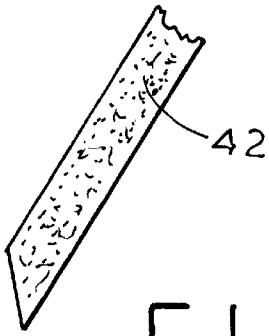
FIG. 7 is another section through the blade.
Figure 6:
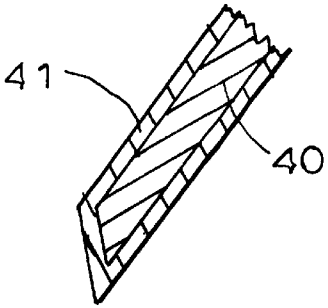
FIG. 6 is a cross section through the blade.

From FIGS. 4*a*, 4*b* and 5, it can be seen that the blades 10, 10' can have a configuration determined by the interior shape of the tubular member 3. A notch 28 is shown in the blade 10 of FIG. 5 and in the blade 10 of FIG. 8, the cutting edge 4" is shown to have a wave shape. The blades 10, 10' can be composed of steel or, as shown in FIG. 6, can have a core 40 of steel and a coating 41 of ceramic or can be formed from sintered ceramic as shown at 42 in FIG. 7. The blades can be mounted replaceably in the tubular member 3 as has been mentioned.

The two blades 10 and 10' with their cutting edges 4, 4' and the notch 20, allow separation of the thread with a minimum pulling force and a minimal length of residual or loose thread ends which must be wound up on the sleeve 27. The edges 4, 4' engage the thread when it is drawn past them and even the slight pull on the thread as it is wound up on the sleeve 27, cutting is effective to cut the thread close to the end of the tubular member and thus leave a short length extending at the winding sleeve.

We claim:

1. A device for moving a thread to a winding sleeve driven by a friction roller, said device comprising:

a suction element connected to a suction source;

a terminal tubular member connected to said element and having a mouth at which a thread is drawn into said member; and two separate blades spaced apart in a direction of travel of the thread and each formed with a respective cutting edge in said terminal tubular member for severing a thread drawn into said device, said blades being oriented diametrically opposite to one another.

2. The device defined in claim 1 wherein said blades are inclined inwardly in a direction in which said thread is drawn into said device.

3. The device defined in claim 1 wherein said edge is blades are respectively mounted in said member.

4. The device defined in claim 1 wherein said blade is formed of a steel core coated with a ceramic.

5. A device for moving a thread to a winding sleeve driven by a friction roller, said device comprising:

a suction element connected to a suction source;

a terminal tubular member connected to said element and having a mouth at which a thread is drawn into said member; and two separate blades spaced apart in a direction of travel of the thread and each formed with a respective cutting edge in said terminal tubular member for severing a thread drawn into said device, said blades being inclined inwardly in a direction in which said thread is drawn into said device, said blades extending inwardly beyond a centerline of said member from locations above and below said centerline, respectively.

6. A device for moving a thread to a winding sleeve driven by a friction roller, said device comprising:

a suction element connected to a suction source;

a terminal tubular member connected to said element and having a mouth at which a thread is drawn into said member; and means forming at least one cutting edge in said terminal tubular member for severing a thread drawn into said device, said mouth having a smaller diameter than said member inwardly of said mouth.

7. The device defined in claim 6 wherein said member is a tube and said mouth is formed by a ring inserted into said tube.

8. The device defined in claim 7 wherein ring is formed from a low-friction material.

9. The device defined in claim 8 wherein said ring is composed of a ceramic.

10. The device defined in claim 6 wherein said edge is formed with a notch.

11. The device defined in claim 6 wherein said edge has a wave shape.

* * * * *